US009677367B2

(12) United States Patent
Nguyen et al.

(10) Patent No.: US 9,677,367 B2
(45) Date of Patent: Jun. 13, 2017

(54) NON-ROTATING METHOD AND SYSTEM FOR ISOLATING WELLHEAD PRESSURE

(71) Applicant: Cameron International Corporation, Houston, TX (US)

(72) Inventors: Dennis P. Nguyen, Pearland, TX (US); Kristin Dale Vorderkunz, Houston, TX (US)

(73) Assignee: Cameron International Corporation, Houston, TX (US)

( * ) Notice: Subject to any disclaimer, the term of this patent is extended or adjusted under 35 U.S.C. 154(b) by 104 days.

(21) Appl. No.: 14/315,179

(22) Filed: Jun. 25, 2014

(65) Prior Publication Data

US 2015/0376977 A1 Dec. 31, 2015

(51) Int. Cl.

| | |
|---|---|
| ***E21B 33/03*** | (2006.01) |
| ***E21B 33/068*** | (2006.01) |
| ***E21B 23/02*** | (2006.01) |
| ***E21B 33/04*** | (2006.01) |

(52) U.S. Cl.

CPC ..... *E21B 33/03* (2013.01); *E21B 23/02* (2013.01); *E21B 33/04* (2013.01); *E21B 33/068* (2013.01)

(58) Field of Classification Search

CPC ..... E21B 33/03; E21B 33/068; E21B 34/02
See application file for complete search history.

(56) References Cited

U.S. PATENT DOCUMENTS

| | | | | |
|---|---|---|---|---|
| 1,997,878 A * | 4/1935 | Wagner | F16L 55/132 | 138/89 |
| 4,019,541 A * | 4/1977 | Koppl | E21B 33/068 | 138/89 |
| 4,503,879 A * | 3/1985 | Lazarus | E21B 33/068 | 137/315.02 |
| 6,675,900 B2 * | 1/2004 | Baskett | E21B 33/043 | 166/368 |
| 8,261,818 B2 * | 9/2012 | Pallini | E21B 41/04 | 166/120 |

(Continued)

FOREIGN PATENT DOCUMENTS

| | | |
|---|---|---|
| CN | 102383756 A | 3/2012 |
| EP | 0715056 A2 | 6/1996 |
| GB | 2312455 A | 10/1997 |

OTHER PUBLICATIONS

PCT International Search Report and Written Opinion; Application No. PCT/US2015/037699; Dated May 3, 2016; 13 pages.

(Continued)

*Primary Examiner* — Shane Bomar
(74) *Attorney, Agent, or Firm* — Fletcher Yoder, P.C.

(57) ABSTRACT

Embodiments of the present disclosure include a plugging assembly configured to be disposed within a production flow bore of a tubing spool tree, wherein the plugging assembly includes a body having a central bore, a lock ring disposed about the body, a support sleeve slidably disposed about the body, and an inner body support pin coupled to the support sleeve and extending into the central bore of the body, wherein axial actuation of the inner body support pin drives the support sleeve between the body and the lock ring to actuate the lock ring radially outward, and wherein the plugging assembly is configured to be disposed within a production flow bore of a tubing spool tree.

20 Claims, 6 Drawing Sheets

(56) References Cited

U.S. PATENT DOCUMENTS

| | | | | |
|---|---|---|---|---|
| 8,544,551 | B2 * | 10/2013 | Nguyen | E21B 33/068 166/192 |
| 2004/0104024 | A1 * | 6/2004 | Kent | E21B 33/0355 166/85.4 |
| 2009/0266551 | A1 | 10/2009 | Cuiper et al. | |
| 2010/0193195 | A1 * | 8/2010 | Nguyen | E21B 33/04 166/338 |
| 2010/0258319 | A1 * | 10/2010 | Nguyen | E21B 23/02 166/373 |
| 2010/0294486 | A1 | 11/2010 | Pallini et al. | |
| 2011/0011598 | A1 * | 1/2011 | Nguyen | E21B 23/01 166/386 |
| 2011/0011599 | A1 * | 1/2011 | Nguyen | E21B 33/068 166/386 |

OTHER PUBLICATIONS

PCT International Preliminary Report on Patentability of Application No. PCT/US2015/037699 dated Jan. 5,2017; 8 pages.

* cited by examiner

NON-ROTATING METHOD AND SYSTEM FOR ISOLATING WELLHEAD PRESSURE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as various control lines, casings, valves, and the like, that control drilling and/or extraction operations.

In drilling and extraction operations, various components and tools, in addition to and including wellheads, are employed to provide for drilling, completion, and production of a mineral resource. Further, during drilling and extraction operations, one or more seals or plugs may be employed to regulate and/or isolate pressures and the like. For instance, a wellhead system often includes a tubing hanger or casing hanger that is disposed within the wellhead assembly and configured to secure tubing and casing suspended in the well bore. The hanger generally provides a path for hydraulic control fluid, chemical injections, or the like to be passed through the wellhead and into the well bore. Additionally, the tubing hanger provides a path for production fluid to be passed through the wellhead and exit the wellhead through a production flow bore to an external production flow line. In certain circumstances, a plug may be used to seal off the production flow bore. For example, a plug may be used to seal off the production flow bore for removal of a spool tree coupled to the production flow bore, re-working of a valve, other maintenance procedures, or other operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present technique include a system and method for plugging a production flow bore with a non-rotating plug. As explained in greater detail below, the disclosed embodiments include a plugging assembly configured to plug a production flow bore (e.g., isolate wellhead pressure), wherein the plug may be installed and removed using linear (e.g., non-rotating) forces. As a result, the plugging assembly may be installed and removed in the production flow bore without an outlet extension (e.g., a radial outlet extension) of the production flow bore (e.g., by using the non-rotating plug rather than a rotating plug, such as a threaded plug). For example, the plugging assembly may include a body with a lock ring disposed about the body. During a running and setting operation of the plugging assembly, the body is positioned within the production flow bore, and a support sleeve disposed about the body may be linearly actuated (e.g., axially actuated along an axis of the horizontal production flow bore) and driven between the body and the lock ring. In this manner, the lock ring is driven radially outward to engage with a lock ring recess of the production flow bore, thereby securing the plugging assembly in place and sealing the production flow bore (e.g., isolating wellhead pressure). As discussed below, the linear actuation force (e.g., axial and/or radial force) may be applied with a manual tool, a hydraulic tool, a side door lubricator, or other tool configured to generate and apply a linear force.

Figure 1:
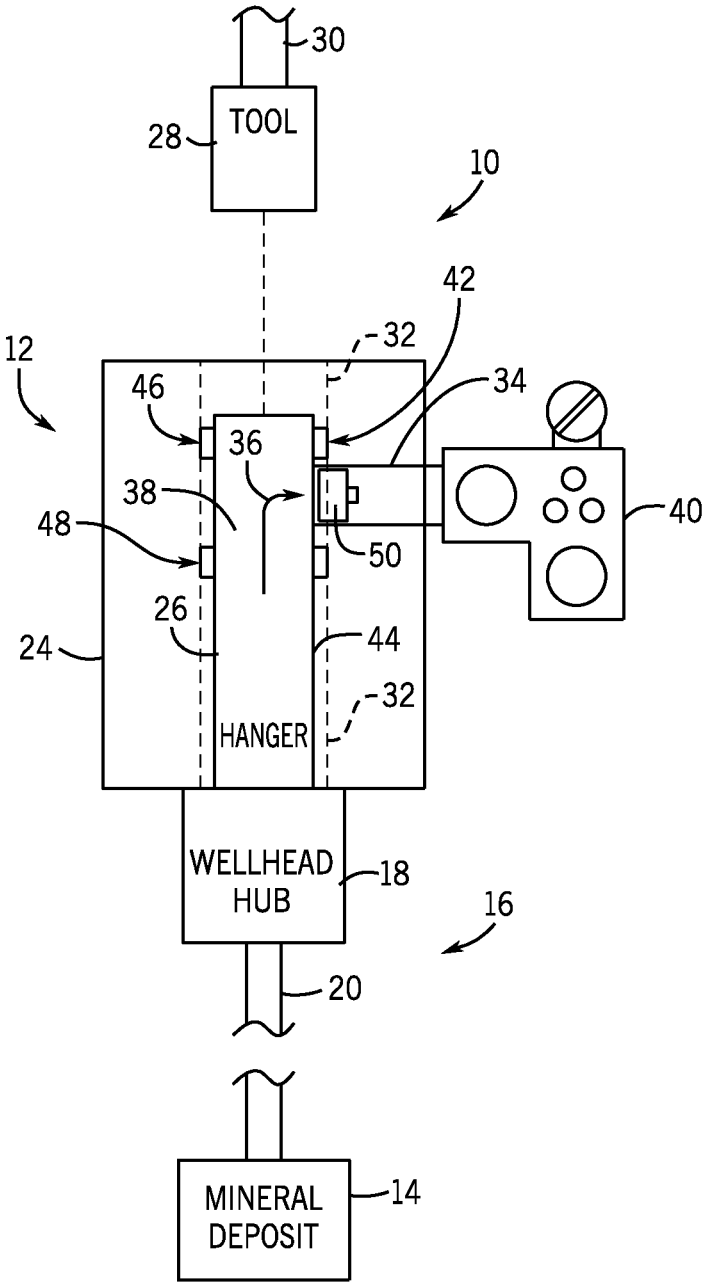
FIG. 1 is a block diagram that illustrates a mineral extraction system, in accordance with an embodiment of the present disclosure.

FIG. 1 illustrates a mineral extraction system 10. The illustrated mineral extraction system 10 can be configured to extract various minerals and natural resources, including hydrocarbons (e.g., oil and/or natural gas), for instance. Further, the system 10 may be configured to inject substances, such as chemicals, steams, or other fluids to enhance mineral extraction. In some embodiments, the mineral extraction system 10 is land-based (e.g., a surface system) or subsea (e.g., a subsea system). As illustrated, the system 10 includes a wellhead 12 coupled to a mineral deposit 14 via a well 16. For example, the well 16 includes a wellhead hub 18 and a well-bore 20.

The wellhead hub 18 may include a large diameter hub that is disposed at the termination of the well bore 20 near the surface. Thus, the wellhead hub 18 may provide for the connection of the wellhead 12 to the well 16. The wellhead 12 may be coupled to a connector of the wellhead hub 18, for instance. Accordingly, the wellhead 12 may include a complementary connector, like a collet connector.

The wellhead 12 generally includes a series of devices and components that control and regulate activities and conditions associated with the well 16. For example, the wellhead 12 may provide for routing the flow of produced minerals from the mineral deposit 14 and the well bore 20, provide for regulating pressure in the well 16, and provide for the injection of chemicals into the well bore 20 (down-hole). In the illustrated embodiment, the wellhead 12 includes a tubing spool tree 24 (e.g., a tubing spool or a horizontal tubing spool tree) and a hanger 26 (e.g., a tubing hanger or a casing hanger). The system 10 may also include devices that are coupled to the wellhead 12, and those that are used to assemble and control various components of the wellhead 12. For example, in the illustrated embodiment, the system 10 also includes a tool 28 suspended from a drill string 30. In certain embodiments, the tool 28 may include running tools that are lowered (e.g., run) from an offshore vessel to the well 16, the wellhead 12, and the like.

The tubing spool tree 24 generally includes a variety of flow paths (e.g., bores), valves, fittings, and controls for operating the well 16. For instance, the tubing spool tree 24 may include a frame that is disposed about a body, a flow-loop, actuators, and valves. Further, the tubing spool tree 24 may provide fluid communication with the well 16. For example, the illustrated tubing spool tree 24 includes a spool bore 32. The spool bore 32 may provide for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tubing spool tree 24. For instance, the tubing spool tree 24 includes a horizontal production flow bore 34 configured to enable a flow of produced minerals from the well 16 to shipping or storage facilities, as indicated by arrow 36. More specifically, the horizontal production flow bore 34 is in fluid communication with a tubing hanger bore 38 that is fluidly connected to the wellbore 20. Thus, produced minerals may flow from the well bore 20, through the tubing hanger bore 38, and through the production fluid bore 34. A flow of produced minerals may be regulated by a production flow spool tree 40 disposed along the production fluid bore 34 and coupled to the tubing spool tree 24. The tubing hanger bore 38 may also provide access to the well bore 20 for various completion and worker procedures. For example, components may be run down to the wellhead 12 and disposed in the tubing hanger bore 34 to seal-off the well bore 20, to inject chemicals down-hole, to suspend tools down-hole, to retrieve tools down-hole, and the like.

As will be appreciated, mineral extractions systems 10 are often exposed to extreme conditions. For example, during drilling and production of a well 16, the well bore 20 may include pressures up to and exceeding 10,000 pounds per square inch (PSI). Accordingly, mineral extraction systems 10 generally employ various mechanisms, such as seals, plugs, and valves, to control and regulate the well 16. For instance, the hanger 26 (e.g., tubing hanger or casing hanger) that is disposed within the wellhead 12 secures tubing and casing suspended in the well bore 20, and provides a path for hydraulic control fluid, chemical injections, and the like to be passed down-hole. Accordingly, the hanger 26 may include a seal assembly 42 that is disposed in an annular region 44 between a body of the hanger 26 and the wellhead 12 (e.g., the tubing spool tree 24), to seal off the annular region 44 from the production flow bore 34. More specifically, the seal assembly 42 includes an upper seal 46 (e.g., annular seal) and a lower seal 48 (e.g., annular seal) that are disposed about the production flow bore 34. In other words, when the seal assembly 42 is installed within the annular region 44 between the hanger 26 and the tubing spool tree 24, the upper seal 46 is disposed on a first axial side of the production flow bore 34, and the lower seal 48 is disposed on a second axial side of the production flow bore 34. As discussed in detail below, the upper and lower seals 46 and 48 may be elastomeric seals, metal seals, metal end cap seals, or other suitable seals. The seal assembly 42 may block pressures in the production flow bore 34 from manifesting through the wellhead 12 (e.g., within the annular region 44), and enable regulation of the pressure in the annular region and the well 16.

Additionally, the wellhead 12 includes a plugging assembly 50 (e.g., a non-rotating plug assembly) disposed within the production flow bore 34. As will be appreciated, the plugging assembly 50 isolates pressure within the wellhead 12 and blocks flow of production fluids through the production flow bore 34. The plugging assembly 50 may be secured within the production flow bore 34 during various operations, such as removal of the production flow spool tree 40, workover procedures, or other operations where it is desirable to block flow of production fluids through the production flow bore 34. As described in detail below, the plugging assembly 50 is configured to be installed and removed from the production flow bore 34 of the tubing spool tree 24 in a non-rotating manner. In other words, the plugging assembly 50 is installed and removed from the production flow bore 34 by applying linear movement (e.g., axial movement) and/or forces to the plugging assembly. For example, the plugging assembly 50 may include a body with a lock ring disposed about the body that is driven radially outward to engage with the tubing spool tree 24 by a linearly actuated support sleeve disposed about the body of the plugging assembly 50. The support sleeve remains between the body and lock ring to keep the lock ring engaged with the tubing spool tree 24, such that the support sleeve secures the plugging assembly 50 within the production flow bore 34. To remove the plugging assembly 50 from the production flow bore 34, the support sleeve 100 may be linearly actuated (e.g., axially actuated) outwards to remove the support sleeve 100 from between the lock ring and body of the plugging assembly 50. This allows the lock ring to disengage from the tubing spool tree 24 and enable removal of the plugging assembly 50 from the production flow bore 34.

As the plugging assembly 50 is installed and removed from the production flow bore 34 by linear actuation, the plugging assembly 50 is not rotated. The non-rotating feature of the plugging assembly 50 is contrastingly different than production flow bore 34 plugging assemblies that may be threaded (e.g., rotated) into place. In order for threaded plugging assemblies to be used, an extended outlet is generally coupled to the production flow bore 34, because tubing spool trees 24 may not be thick enough to provide an adequate number of threads for threading and securing a plugging assembly into place within the production flow bore 34. Therefore, the presently disclosed embodiments of the plugging assembly 60, which are installed and removed linearly and without rotation (e.g., without threads), enable the plugging and sealing of the production flow bore 34 without an extended outlet or other type of extension coupled to the tubing spool tree 24.

Figure 2:
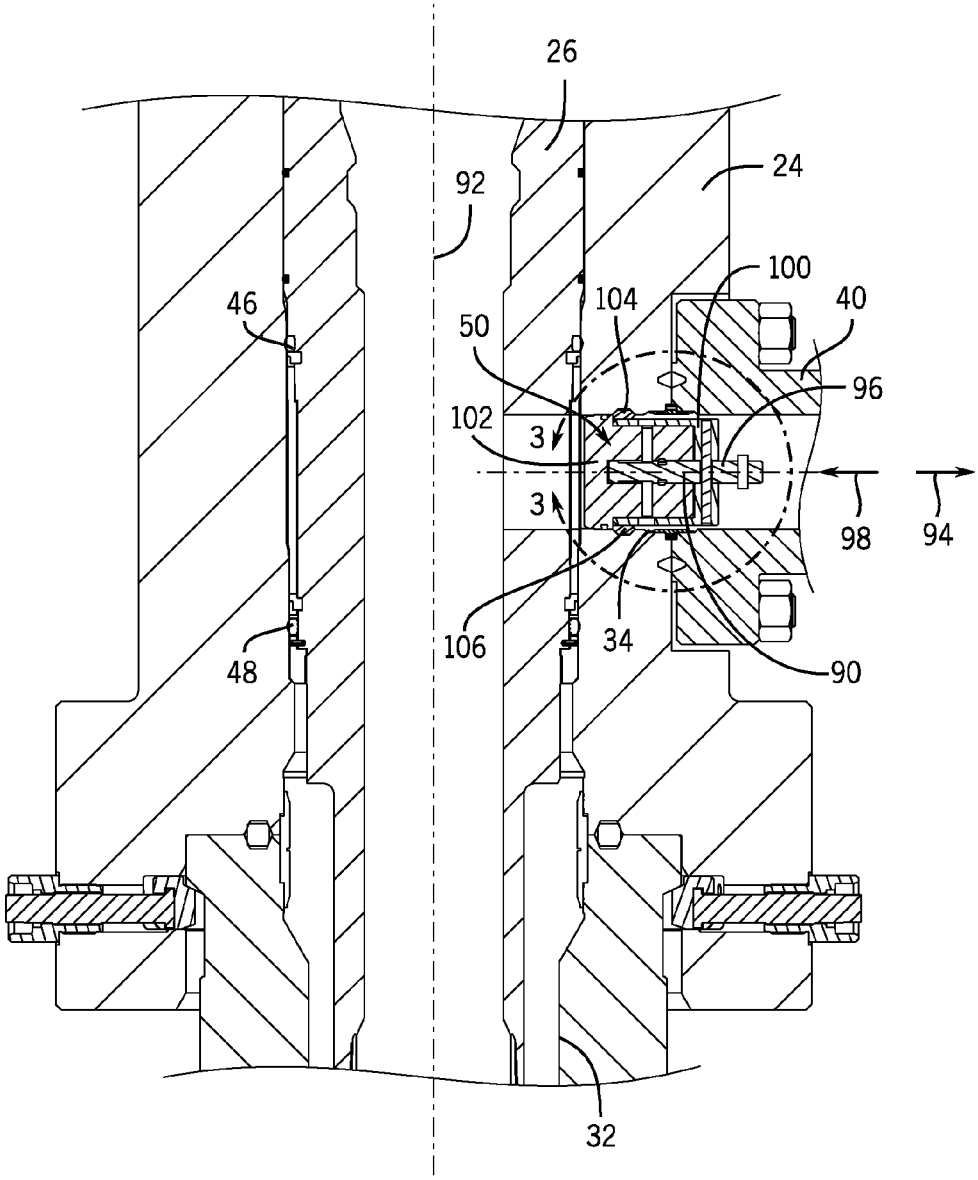
FIG. 2 is a cross-section of a wellhead assembly with a tubing hanger, a tubing spool, and a spool tree, in accordance with an embodiment of the present disclosure.

FIG. 2 is a cross-section of the wellhead 12, illustrating the plugging assembly 50 secured within the production flow bore 34. As mentioned above, the plugging assembly 50 may be installed by applying a linear force (e.g., an axial force) to the plugging assembly 50. In particular, the plugging assembly 50 may be positioned within the production flow bore 34 of the tubing spool tree 24, and a linear actuation force may be applied to an inner body support pin 96 of the plugging assembly 50 in a direction 98 (e.g., along a first axis 90 of the production flow bore 34 and radially relative to a second axis 92 of the tubing spool tree 24). As the inner body support pin 96 is actuated in the direction 98, a support sleeve 100 of the plugging assembly 50 disposed about a body 102 of the plugging assembly 50 engages with a lock ring 104 (e.g., a C-ring, radially inwardly biased lock ring, or other suitable lock ring) of the plugging assembly 50 and drives the lock ring 104 radially outward relative to axis 92. When the lock ring 104 is in the radially outward position shown in FIG. 2, the lock ring 104 is engaged with a lock ring recess 106 (e.g., annular recess) of the production flow bore 34. The lock ring 104 and the lock ring recess 106 may have similar contours, such that the lock ring 104 and the lock ring recess 106 mate with one another and block axial movement (along axis 92) of the plugging assembly 50 within the production flow bore 34. As discussed in further detail below, the plugging assembly 50 may also have a retainer (e.g., inner lock ring) to hold the support sleeve 100 in position between the body 102 and the lock ring 104 when the plugging assembly 50 is in a plugged position within the production flow bore 34. To remove the plugging assembly 50 from the production flow bore 34, a linear actuation force may be applied to the inner body support pin 96 in a direction 94 (e.g., opposite direction 98) to disengage the retainer and the lock ring 104 and enable removal of the plugging assembly 50 from the production flow bore 34. The operation of the components of the plugging assembly 50 is described in further detail below with reference to FIG. 3.

Figure 3:
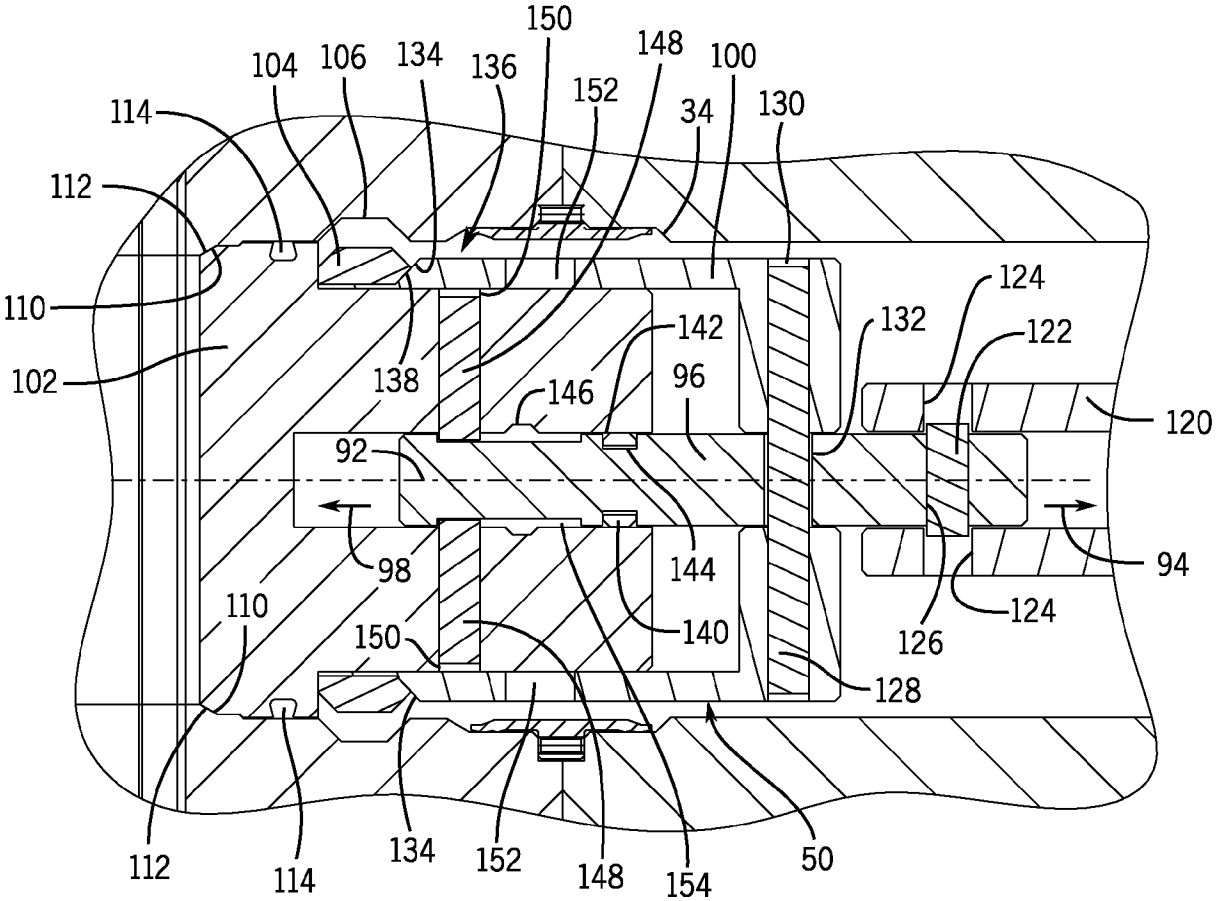
FIG. 3 is a cross-section of an embodiment of a plug assembly, in accordance with an embodiment of the present disclosure.

FIG. 3 is a cross-section of an embodiment of the plugging assembly 50 disposed within the production flow bore 34 of the tubing spool tree 24. The plugging assembly 50 may be positioned within the production flow bore 34 by applying a linear force on the plugging assembly 50 in the direction 98 (e.g., along axis 92). The plugging assembly 50 is landed within the production flow bore 34 when a landing surface 110 (e.g., annular surface) of the body 102 of the plugging assembly 50 abuts a stopping shoulder 112 (e.g., an annular landing shoulder) of the production flow bore 34. The landing surface 110 and the stopping shoulder 112 engage with one another to block further axial movement of the plugging assembly 50 in the direction 98. The body 102 of the plugging assembly 50 further includes a seal 114, which creates a sealing interface between the body 102 and the production flow bore 34 to isolate pressure within the wellhead 12 and blocks flow of production fluids through the production flow bore 34. In certain embodiments, the seal 114 may be an annular seal and may be a metal end cap seal, an elastomeric seal, or other suitable seal.

In the illustrated embodiment of FIG. 3, the plugging assembly 50 is landed within the production flow bore 34, and the support sleeve 100 has made initial contact with the lock ring 104 during actuation of the plugging assembly 50. However, the support sleeve 100 has not yet been actuated (e.g., linearly actuated) to drive the lock ring 104 radially outward relative to axis 92. As mentioned above, the plugging assembly 50 is actuated by applying a linear force to the inner body support pin 96 of the plugging assembly 50 along axis 92. For example, the linear force may be applied by a tool adapter 120, which may be a mechanical tool, a manual tool, a hydraulic tool, and electromechanical tool, or other type of tool configured to apply a linear force. In the illustrated embodiment, the tool is coupled to the inner body support pin 96 by a tool connector pin 122, which extends through an aperture or slot (e.g., J-slot) 124 of the of the tool adapter 120 and an aperture or slot 126 of the inner body support pin 96 to couple the tool adapter 120 to the inner body support pin 96. As a result, a linear force applied by the tool adapter 120 (e.g., along axis 92) will be transferred to the inner body support pin 96.

The linear actuation of the inner body support pin 96 is further transferred to the support sleeve 100 extending about the body 102 of the plugging assembly 50. As shown, the inner body support pin 96 is coupled to the support sleeve 100 by a guide pin 128 that extends through an aperture 130 of the support sleeve 128 and an aperture 132 of the inner body support pin 96. In this manner, the guide pin 128 couples the support sleeve 100 to the inner body support pin 96, such that linear actuation of the inner body support pin 96 may be transferred to the support sleeve 102.

When the support sleeve 100 is linearly actuated in the direction 98 along axis 92, the support sleeve 100 will contact the lock ring 104, as shown. In particular, an angled surface 134 (e.g., chamfered surface or conical surface) of an axial end 136 of the support sleeve 100 will contact a corresponding angled surface 138 (e.g., chamfered surface or conical surface) of the lock ring 104. As the support sleeve 100 is further actuated in the direction 98 along axis 92, the engagement of the angled surfaces 134 and 138 will transfer the linear movement (e.g., axial movement) of the support sleeve 100 into radial movement (relative to axis 92) of the lock ring 104. In this manner, the lock ring 104 will be driven radially outward to engage with the lock ring recess 106 of the production flow bore 34. As mentioned above, the lock ring 104 and the lock ring recess 106 have complimentary contours and may engage with one another to block axial movement of the plugging assembly 50 within the production flow bore 34.

As mentioned above, the plugging assembly 50 also has a retainer that enables the plugging assembly 50 to remain in the set position with the support sleeve 100 positioned between the body 102 and the lock ring 104 and with the lock ring 104 engaged with the lock ring recess 106 of the production flow bore 34. As shown in FIG. 3, the plugging assembly 50 includes an inner lock ring 140 positioned radially between the inner body support pin 96 and a central bore 142 of the body 102. In the running position of the plugging assembly 50 shown in FIG. 3, the inner lock ring 140 is retained within an annular recess 144 of the inner body support pin 96.

Once the plugging assembly 50 is in the set position (e.g., with the support sleeve 100 fully positioned between the body 102 and the lock ring 104), the inner lock ring 140 will expand radially outward (e.g., automatically expand radially outward) and engage with an inner lock ring recess 146 formed in the central bore 142 of the body 102. As shown, the inner lock ring 140 and the inner lock ring recess 146 may have similar contours to enable engagement between the inner lock ring 140 and the inner lock ring recess 146. When the inner lock ring 140 is engaged with the lock ring recess 146, linear translation (e.g., undesired linear translation) of the inner body support pin 96 may be blocked. In this manner, unintentional or undesired disengagement of the plugging assembly 50 within the production flow bore 34 may be blocked.

The sizing and/or contours of the inner lock ring 140 and inner lock ring recess 146 may be selected to enable disengagement of the inner lock ring 140 from the inner lock ring recess 146 upon application of a desired or selected linear force to the inner body support pin 96 in direction 94. As a result, the plugging assembly 50 may be disengaged and removed from the production flow bore 34 in a desired and controlled manner. Specifically, a sufficient linear force in the direction 94 may be applied to the inner body support pin 96, which will cause the inner lock ring 140 to move radially and disengage with the inner lock ring recess 146. As the inner body support pin 96 is linearly actuated in the direction 94, the support sleeve 100 may also translate in the direction 94, thereby allowing the lock ring 104 to move radially and disengage with the lock ring recess 106 and enabling removal of the plugging assembly 50 from the production flow bore 34.

Guide pins 148 (e.g., radial guide pins) positioned within respective slots 150 (e.g., radial slots) of the body 102 may restrict movement (e.g., axial movement) of the inner body support pin 96 relative to the body 102. In the illustrated embodiment, two guide pins 148 are shown disposed on opposite sides of the inner body support pin 96 relative to one another. However, other embodiments of the plugging assembly 50 may include other numbers of guide pins 148 disposed in respective slots 150. For example, the plugging assembly 150 may include 3, 4, 5, 6, 7, 8, or more guide pins 148, and, in certain embodiments, the guide pins 148 may be spaced equidistantly in a circumferential direction about the inner body support pin 96. Each guide pin 148 may be installed within the respective slot 150 of the body through one or more apertures 152 formed in the support sleeve 100.

The guide pins 148 extend from the body 102 (e.g., from the central bore 142 of the body 102) into an annular recess 154 of the inner body support pin 96. In this manner, the guide pins 148 may block excessive axial movement of the inner body support pin 96 relative to the body 102, thereby blocking undesired disassembly of the plugging assembly 50. However, the axial distance or length of the annular recess 154 is such that sufficient axial movement of the inner body support pin 96 is possible or allowed to enable the engagement and disengagement of the plugging assembly 50 described above.

Figure 4:
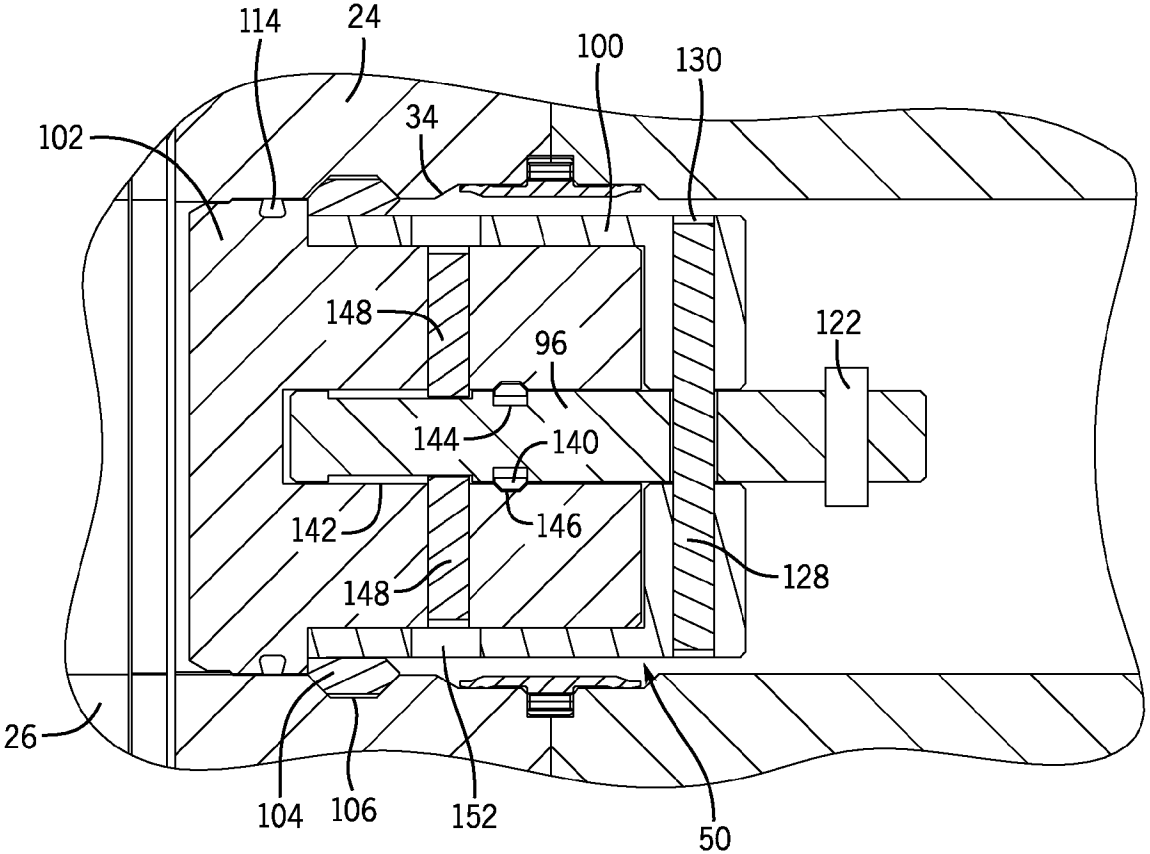
FIG. 4 is a cross-section of an embodiment of a plug assembly in an engaged or locked position within a production flow bore, in accordance with an embodiment of the present disclosure.

FIG. 4 is a cross-sectional view of the wellhead 12, illustrating the plugging assembly 50 in an installed, locked, and/or set position. As shown in the illustrated embodiment, when the plugging assembly 50 is in the set position, the support sleeve 100 is positioned between the body 102 and the lock ring 104. As a result, the lock ring 104 is driven radially outward to engage with the lock ring recess 106 of the production flow bore 34. The lock ring 104 and the lock ring recess 106 have complimentary contours and engage with one another to block axial movement of the plugging assembly 50 within the production flow bore 34. Additionally, when the plugging assembly 50 is in the set position, the inner lock ring 140 is expanded radially outward (e.g., automatically expand radially outward) and engaged with the inner lock ring recess 146 formed in the central bore 142 of the body 102. As with the lock ring 104 and the lock ring recess 106, the inner lock ring 140 and the inner lock ring recess 146 have similar contours to enable engagement between the inner lock ring 140 and the inner lock ring recess 146. When the inner lock ring 140 is engaged with the lock ring recess 146 as shown, linear translation (e.g., undesired linear translation) of the inner body support pin 96 may be blocked. In this manner, unintentional or undesired disengagement of the plugging assembly 50 within the production flow bore 34 may be blocked.

Figure 5:
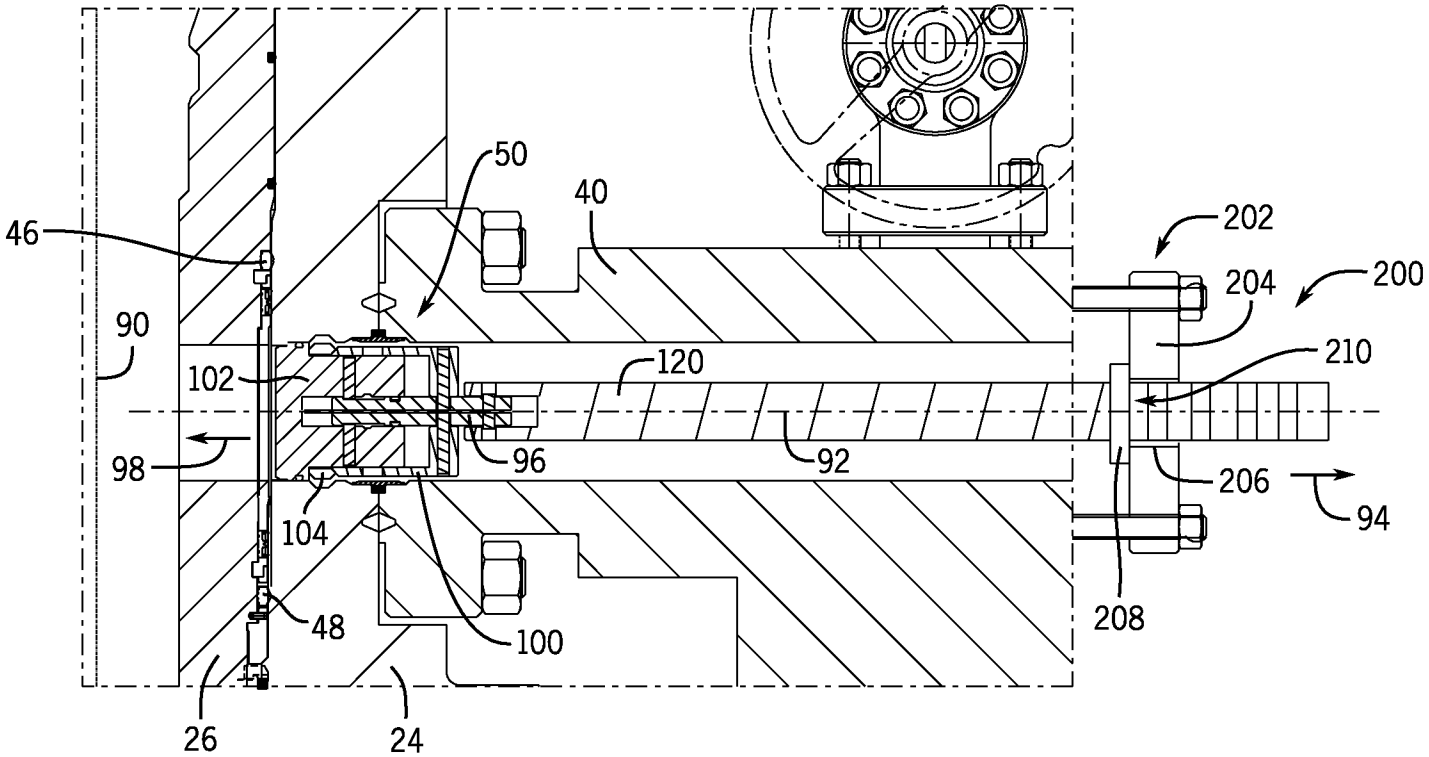
FIG. 5 is a cross-section of a wellhead assembly with a tubing hanger, a tubing spool, and a spool tree, illustrating an installation of a plug assembly with an installation tool, in accordance with an embodiment of the present disclosure.

FIG. 5 is a cross-sectional view of the wellhead 12, illustrating an installation of the plugging assembly 50 with a tool 200. In particular, the illustrated embodiment shows an installation tool 202 that may be used to running the plugging assembly 50 into the production flow bore 34 and set the plugging assembly 50 within the production flow bore 34. In certain embodiments, the tool 200 (e.g., the installation tool 202) may be a manual tool, a motorized tool, and electromechanical tool, a hydraulic tool, a side door lubricator, or other type of tool configured to apply a linear force.

As discussed in detail above, the plugging assembly 50 is installed and actuated within the production flow bore 34 by applying a linear, non-rotating force to the plugging assembly 50 (e.g., the inner body support pin 96). As such, the installation tool 202 is configured to apply a linear force along axis 92 to the inner body support pin 96 of the plugging assembly 50. In the illustrated embodiment, the installation tool 202 applies the linear force via the tool adapter 120, which extends from the installation tool 202 to the plugging assembly 50 through the production flow spool tree 40. The installation tool 202 may further be configured to maintain an aligned position of the tool adapter 120 within the production flow bore 34. For example, the installation tool 202 may keep the tool adapter 120 centered within the production flow bore 34. As a result, the installation tool 202 may apply a centered force to the tool adapter 120 and the plugging assembly 50.

The installation tool 202 includes a flange 204 with an aperture 206 that receives the tool adapter 120. The flange 204 of the installation tool 202 abuts a flange 208 of the tool adapter 120 on a first (e.g., outer) side 210 of the flange 208. During operation, the flange 204 of the installation tool 202 applies a linear force to the flange 208 of the tool adapter 120 in the direction 98, thereby driving the tool adapter 120 in the direction 98 to actuate the plugging assembly 50. In certain embodiments, the tool adapter 120, the aperture 206, and/or the flanges 206 and 208 may included threads configured engage with one another. The threaded engagement between the installation tool 202 and the tool adapter 120 may block unintended ejection or movement of the tool adapter 120 and/or the plugging assembly 50 during periods of elevated pressure within the production flow bore 34.

Figure 6:
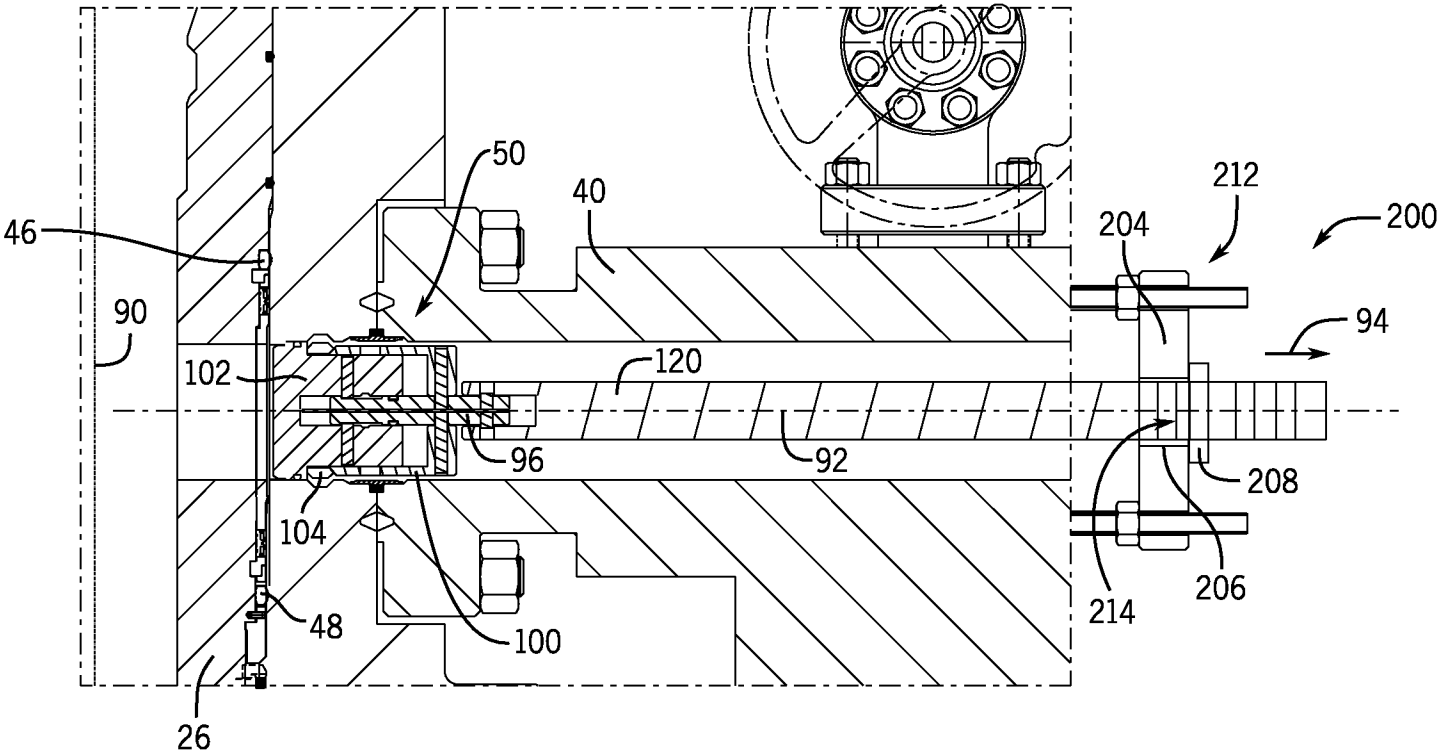
FIG. 6 is a cross-section of a wellhead assembly with a tubing hanger, a tubing spool, and a spool tree, illustrating a removal of a plug assembly with a removal tool, in accordance with an embodiment of the present disclosure.

FIG. 6 is a cross-sectional view of the wellhead 12, illustrating an installation of the plugging assembly 50 with the tool 200. In particular, the illustrated embodiment shows a removal tool 212 that may be used to running the plugging assembly 50 into the production flow bore 34 and set the plugging assembly 50 within the production flow bore 34. The installation tool 202 shown in FIG. 5 may be the same as the removal tool 212 shown in FIG. 6. However, in certain embodiments, the tools 202 and 212 may be different. During removal of the plugging assembly 50, the flange 204 of the removal tool 212 abuts a flange 208 of the tool adapter 120 on a second (e.g., inner) side 214 of the flange 208. To remove the plugging assembly 50 from the production flow bore 34, the flange 204 of the installation tool 202 applies a linear force to the flange 208 of the tool adapter 120 in the direction 94, thereby driving the tool adapter 120 in the direction 94 to disengage and remove the plugging assembly 50 from the production flow bore 34.

As discussed in detail above, embodiments of the present technique include a system and method for plugging the production flow bore 34 with a non-rotating plugging assembly 50 (e.g., plug assembly). In other words, the plugging assembly 50 may be installed and removed using linear (e.g., non-rotating) forces. As a result, the plugging assembly 50 may be installed and removed in the production flow bore 34 without an outlet extension of the production flow bore 34 (e.g., a radial outlet extension extending the production flow bore 34 from the tubing spool tree 24), which are typically used with traditional, threaded plugs. As described above, the plugging assembly 50 may include the body 102 with the lock ring 104 (e.g., C-ring) disposed about the body 102. During a running and setting operation of the plugging assembly 50, the body 102 is positioned within the production flow bore 34, and the support sleeve 100 disposed about the body 102 is linearly actuated and driven between the body 102 and the lock ring 104. In this manner, the lock ring 104 is driven radially outward to engage with the lock ring recess 106 of the production flow bore 34, thereby securing the plugging assembly 50 in place and sealing the production flow bore 34 (e.g., isolating wellhead pressure).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a plugging assembly configured to be disposed within a production flow bore of a tubing spool tree, wherein the plugging assembly comprises:

a body;

a lock ring disposed about the body; and a support sleeve slidably disposed about the body and extending at least partially over an axial end face of the body, wherein the support sleeve is configured to axially extend between the body and the lock ring and drive the lock ring radially outward during actuation of the plugging assembly.

2. The system of claim 1, wherein the body comprises a stopping shoulder configured to engage with a landing shoulder of the production flow bore.

3. The system of claim 1, wherein the plugging assembly comprises an inner body support pin coupled to the support sleeve and extending into a central bore of the body.

4. The system of claim 3, wherein the inner body support pin comprises an inner lock ring disposed within an annular recess of the inner body support pin, wherein the inner lock ring is configured to engage with an inner lock ring recess of the central bore of the body when the plugging assembly is in an actuated position.

5. The system of claim 3, wherein the plugging assembly comprises a plurality of guide pins extending from the body into the central bore of the body and into an annular recess of the inner body support pin to restrict axial movement of the inner body support pin.

6. The system of claim 1, wherein the body comprises a seal configured to engage with the production flow bore.

7. The system of claim 6, wherein the seal comprises a metal end cap seal, an elastomer seal, an O-ring, or any combination thereof.

8. The system of claim 1, wherein the support sleeve comprises an axial end with a first angled surface, the lock ring has a second angled surface, and the first and second angled surfaces are configured to engage with one another to transfer linear movement of the support sleeve to radial movement of the lock ring.

9. The system of claim 1, comprising a tool configured to apply an axial force to the plugging assembly to drive the support sleeve in between the body and the lock ring.

10. The system of claim 9, wherein the tool comprises a manual tool, a hydraulic tool, an electromechanical tool, a side door lubricator, or any combination thereof.

11. The system of claim 1, comprising the tubing spool tree having the production flow bore, wherein the production flow bore is a horizontal production flow bore.

12. A system, comprising:

a plugging assembly, comprising:

a body comprising a central bore;

a lock ring disposed about the body;

a support sleeve slidably disposed about the body; and an inner body support pin coupled to the support sleeve and extending into the central bore of the body, wherein axial actuation of the inner body support pin drives the support sleeve between the body and the lock ring to actuate the lock ring radially outward, and wherein the plugging assembly is configured to be disposed within a production flow bore of a tubing spool tree.

13. The system of claim 12, wherein the lock ring comprises a C-ring.

14. The system of claim 12, wherein the inner body support pin comprises an inner lock ring disposed within an annular recess, wherein the inner lock ring is configured to automatically expand radially outward into an inner lock ring recess of the central bore when the support sleeve is disposed between the body and the lock ring.

15. The system of claim 12, wherein the body comprises an annular seal disposed about a circumference of the body, wherein the seal is configured to create a sealing interface with the production flow bore, and the seal comprises a metal end cap seal, an elastomer seal, an O-ring, or any combination thereof.

16. The system of claim 12, wherein the body comprises a stopping shoulder configured to engage with a landing shoulder of the production flow bore when the plugging assembly is disposed within the production flow bore.

17. A method, comprising:

disposing a plugging assembly within a horizontal production flow bore of a tubing spool tree;

linearly driving a support sleeve of the plugging assembly radially between a main body of the plugging assembly and a lock ring of the plugging assembly relative to a central axis of the plugging assembly with a linear, non-rotational force;

transferring linear movement of the support sleeve to radial movement of the lock ring;

engaging the lock ring with a lock ring recess of the horizontal production flow bore.

18. The method of claim 17, comprising engaging a stopping shoulder of the main body with a landing shoulder of the production flow bore, and creating a sealing interface between a seal disposed about the main body with the production flow bore.

19. The method of claim 17, comprising engaging an inner lock ring of an inner body support pin of the plugging assembly with an inner lock ring recess of a central bore of the main body to restrict movement of the support sleeve when the support sleeve is disposed between the lock ring and the main body.

20. The method of claim 17, wherein linearly driving the support sleeve of the plugging assembly between the main body of the plugging assembly and the lock ring of the plugging assembly comprises applying a linear force to the support sleeve with a manual tool, a hydraulic tool, an electromechanical tool, a side door lubricator, or any combination thereof.

* * * * *